United States Patent [19]

Entwistle

[11] Patent Number: 4,689,107

[45] Date of Patent: Aug. 25, 1987

[54] APPLICATOR FOR WALLBOARD TAPE

[76] Inventor: James A. Entwistle, 1000 Ocean Ave., Belmar, N.J. 07719

[21] Appl. No.: 788,491

[22] Filed: Oct. 17, 1985

[51] Int. Cl.[4] ..... B44C 7/04; B44C 7/08

[52] U.S. Cl. ..... 156/465; 156/524; 156/531; 156/577; 156/578

[58] Field of Search ..... 156/575, 577, 578, 71, 156/524, 531, 465

[56] References Cited

U.S. PATENT DOCUMENTS

| | | | |
|---|---|---|---|
| 2,288,987 | 7/1942 | Allen | 156/575 |
| 2,858,953 | 11/1958 | Harrell | 156/575 |
| 3,006,495 | 10/1961 | Miller | 156/575 |
| 3,188,262 | 6/1965 | Torrison | 156/575 |
| 3,707,427 | 12/1972 | Erickson | 156/575 |
| 4,452,663 | 6/1984 | Heaton | 156/575 |

*Primary Examiner*—Donald E. Czaja
*Assistant Examiner*—J. Davis
*Attorney, Agent, or Firm*—Lawrence J. Shurupoff

[57] ABSTRACT

Wallboard tape and compound are simultaneously dispensed through an applicator which is provided with a pressurized reservoir which acts as a fluid capacitor to ensure an even application of compound to the tape, even under intermittent and uneven tape application rates. Applicator nozzles are provided for applying the tape and compound to flat surfaces as well as to corner joints. Compound is wiped from the edges of the tape and the remaining compound is subsequently spread laterally to these wiped edge areas so that no excess compound is extruded from under the tape, thereby avoiding subsequent wiping and clean-up procedures.

10 Claims, 22 Drawing Figures

FIG. 10
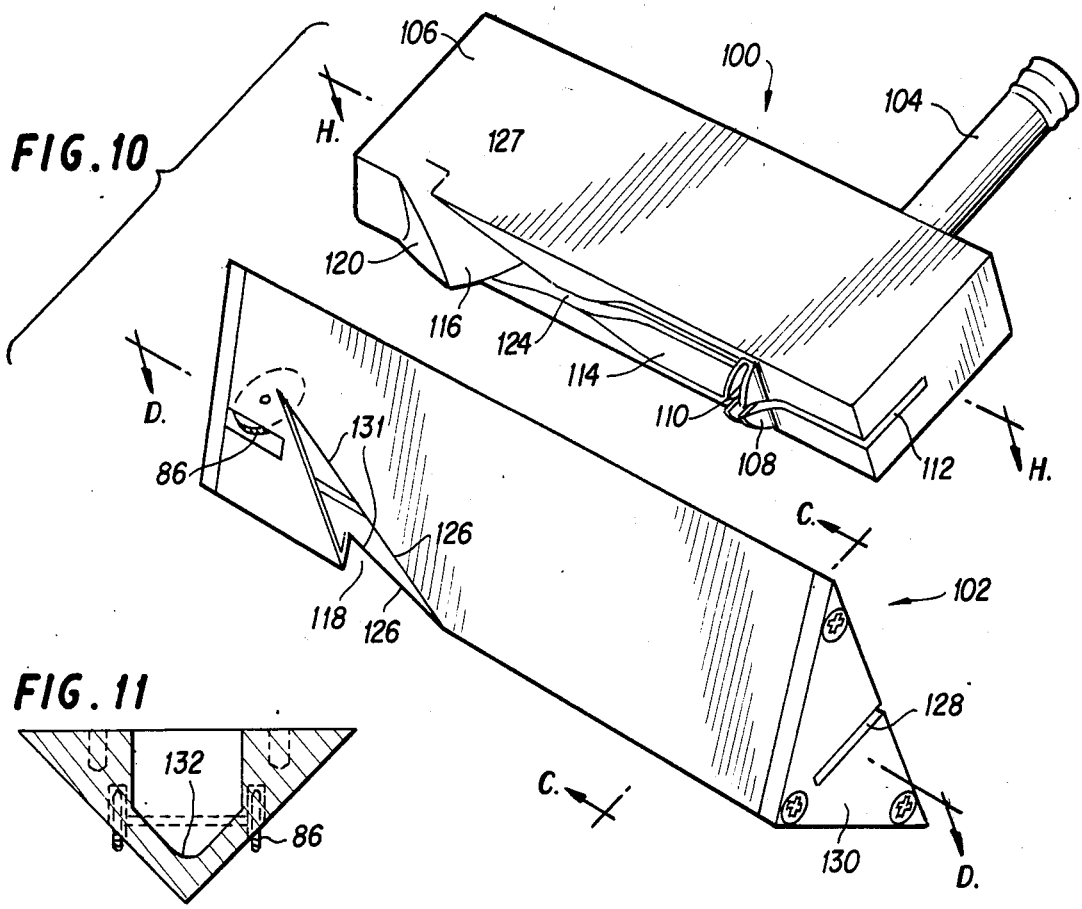
FIG. 11
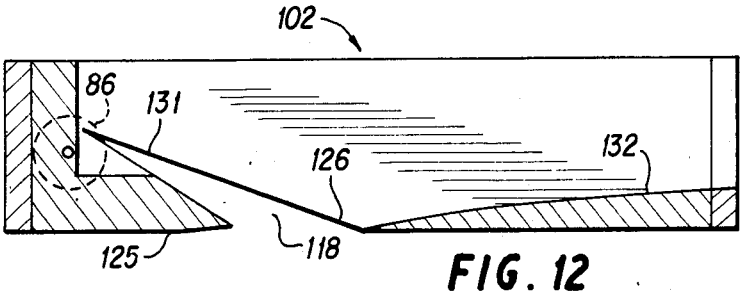
FIG. 12
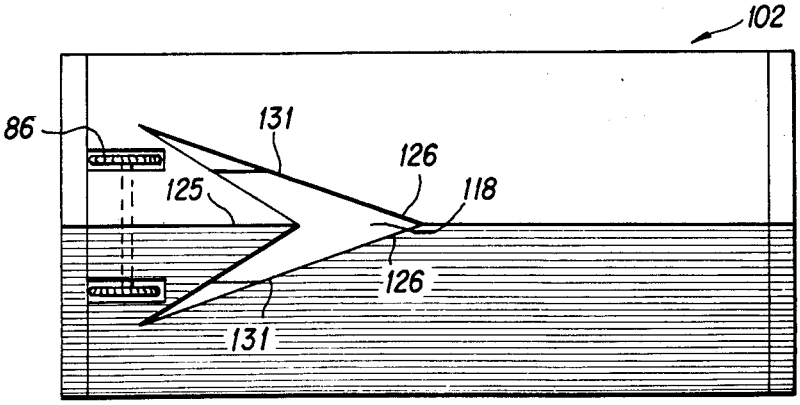
FIG. 13

APPLICATOR FOR WALLBOARD TAPE

BACKGROUND OF THE INVENTION

1. Field of the Invention

This invention relates generally to a drywall finishing apparatus and particularly relates to a simple, lightweight device which applies wallboard compound and wallboard tape to a wallboard joint while wiping the tape and compound, all during the same operative stroke.

2. Description of Prior Developments

Drywall, sheetrock or wallboard is typically fastened to the internal framework of most residential and commercial buildings. Large panels of wallboard are usually nailed to wooden "studs" to form the interior wall and ceiling surfaces. In order to provide a smooth, continuous surface across the cracks or joints formed between abutting wallboard panels, thin covering strip of a fiberous or paper-like material is applied so as to cover the crack.

Although this covering material lacks any adhesive coating, it is referred to in the trade as wallboard "tape". In order to permanently secure this tape across the wallboard joints, an adhesive called wallboard compound or "mud" is first spread over the wall and the tape is subsequently applied to the joint. This procedure has typically required considerable effort and skill. In order to expedite this tape application procedure, various devices have been developed which simultaneously apply the tape and compound over the joint.

While these applicators generally apply tape and compound at a faster rate than that possible by manual methods using simple hand tools, they have been found to perform less than totally satisfactorily. That is, most conventional mechanized tape and compound applicators experience one or more of a host of annoying drawbacks well known to be associated with such applicators. This has resulted in generally poor acceptance of these devices by the building trades.

A particularly bothersome drawback of several conventional compound and tape applicators is the need to wipe down the tape and compound once it has been applied to the joint. That is, these applicators are unable to adequately smooth or iron out the tape and compound so as to form a continuous, even surface during the same stroke in which they are dispensed. This condition requires an additional follow-up or clean-up procedure wherein excess compound is removed with a putty knife and irregularities such as bumps and bubbles formed beneath the tape are flattened. In practice, this type of operation requires at least two workmen - one to operate the applicator and one to follow behind to clean up the excess compound and smooth out any surface imperfections.

The irregularities referred to above are often the result of an intermittent or poorly controlled wallboard compound feed rate. Several devices are fed by a spring-loaded mechanism similar to those used in grease guns. These spring-loaded feed mechanisms frequently fail to provide a smooth, continuous supply of compound to the applicator nozzle. This results in a sporadic flow of compound to the tape and generates bubbles within the compound which appear as bumps or depressions beneath the tape.

Another drawback associated with presently available automated or mechanized tape and compound applicators is their cumbersome and complicated structure. An applicator loaded with compound can weigh up to 40 pounds and extend over a length of 4 to 5 feet. Use of such a device rapidly fatigues the operator. Moreover, fine finishing work is most difficult to achieve with such an awkward, heavy device.

The complicated structure of many applicators leads to frequent breakdowns and necessitates involved and costly repairs. One such applicator is known to include over 20 moving parts and is highly prone to failure.

Still another drawback of prior applicators is their inability to adequately produce a clean, "tight" corner or angle joint. That is, while somewhat satisfactory results have been achieved in applying tape and compound on flat surfaces, angle joints formed along corners and at the junction of walls and ceilings have continually presented an unsolved problem to conventional applicators. These applicators are simply unable to apply the tape and compound at the 90 degree angle typically formed at corners and at wall-ceiling joints.

Accordingly, a need exists for a simple, lightweight applicator which smoothly and efficiently applies a continuous even coating of wallboard compound to a strip of wallboard tape and simultaneously wipes down the tape so as to obviate the need for a subsequent wiping and clean-up procedure.

The realization of these and various other objects, features and attendant advantages of the present invention will be more fully appreciated from the following description when considered in connection with the accompanying drawings, in which the same reference numbers designate the same or corresponding parts throughout.

BRIEF DESCRIPTION OF THE DRAWINGS

The various details of the present invention are described hereinafter with reference to the drawings in which:

FIG. 10 is a perspective, partially exploded view of the nozzle casing for corner applications;

FIG. 11 is a transverse sectional view through the nozzle trough taken along line C—C of FIG. 10;

FIG. 12 is a longitudinal sectional view through the nozzle trough taken along line D—D of FIG. 10;

FIG. 13 is a bottom plan view of the nozzle trough;

DETAILED DESCRIPTION OF THE PREFERRED EMBODIMENTS

Figure 1:
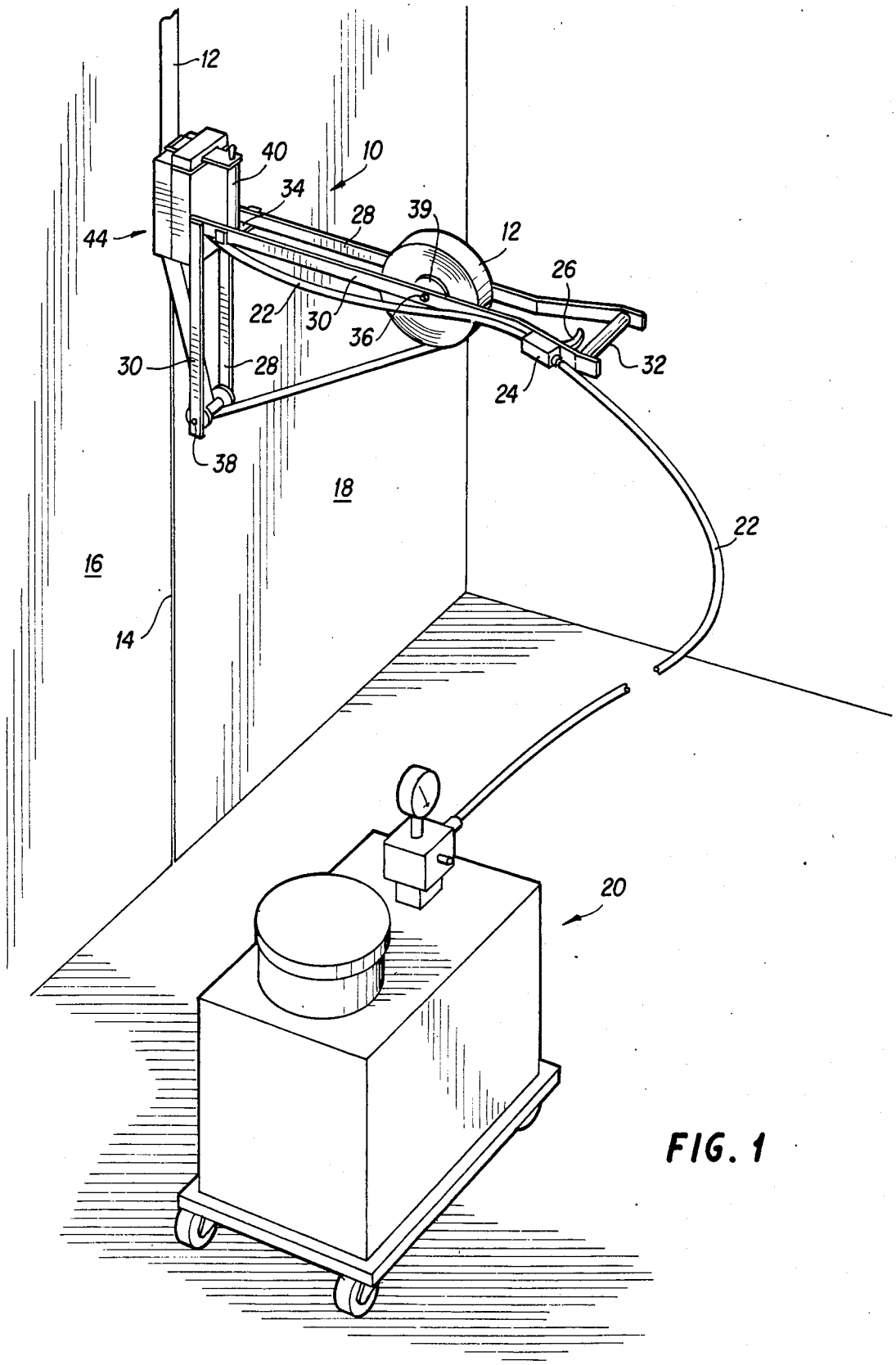
FIG. 1 is a schematic perspective view of the applicator and pressurized compound container showing the applicator applying tape and compound over a crack.

The invention will now be described in conjunction with the accompanying drawings, beginning with FIG. 1 which schematically shows the applicator 10 in an operative position dispensing wallboard tape 12 and wallboard compound over a crack 14 formed between abutting wallboards 16,18. A pressurized container 20 of known construction is filled with wallboard compound and pressurized with air at a suitable pressure, such as 100 psi.

The wallboard compound, known in the trade as "mud", is fed from the pressurized container to the applicator via hose 22. A metering valve 24 is mounted on the applicator and connected to hose 22 to allow an operator to adjust the flow of mud through the applicator to any desired rate by controlling the valve opening with valve actuator lever 26. Alternatively, the metering valve may be mounted on the pressurized container and set at a fixed value to allow the operator to apply the mud and tape in a continuous uninterrupted manner.

The applicator is supported by a pair of L-shaped frame members or braces 28,30 which are interconnected by handle 32, cross brace 34, and axle or pin members 36 and 38. A grip bar 40 is fixed to the cross brace 34 and a roll of tape 12 is removably mounted between the frame members upon tape spindle 39 mounted on pin 36. The tape is guided over a spool or roller 42 which is rotatably mounted over pin 38. An applicator head 44 is fixed to the frame members to receive the tape after it passes over spool 42.

Figure 2:
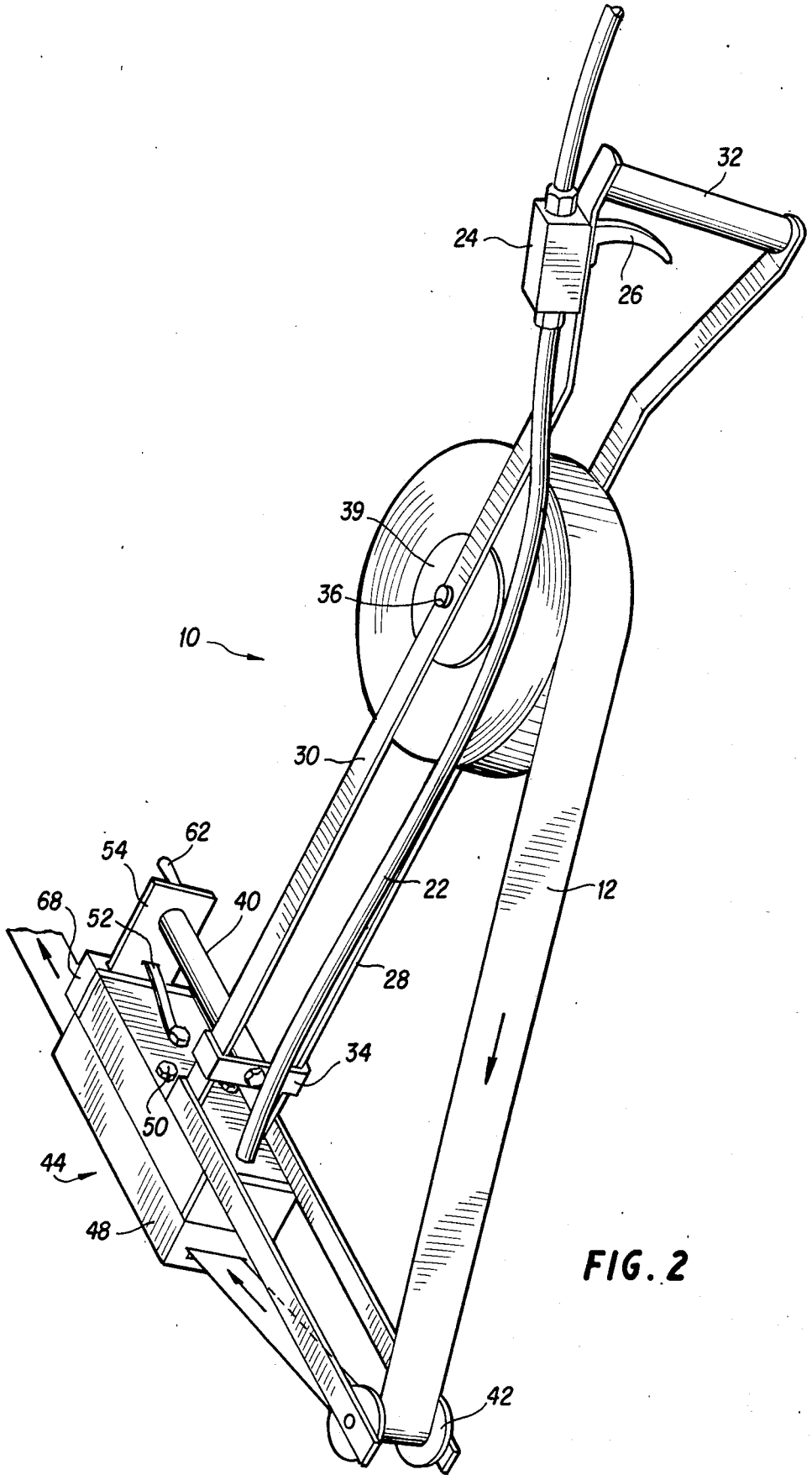
FIG. 2 is a perspective view of the applicator showing the path through which the tape is dispensed.
Figure 3:
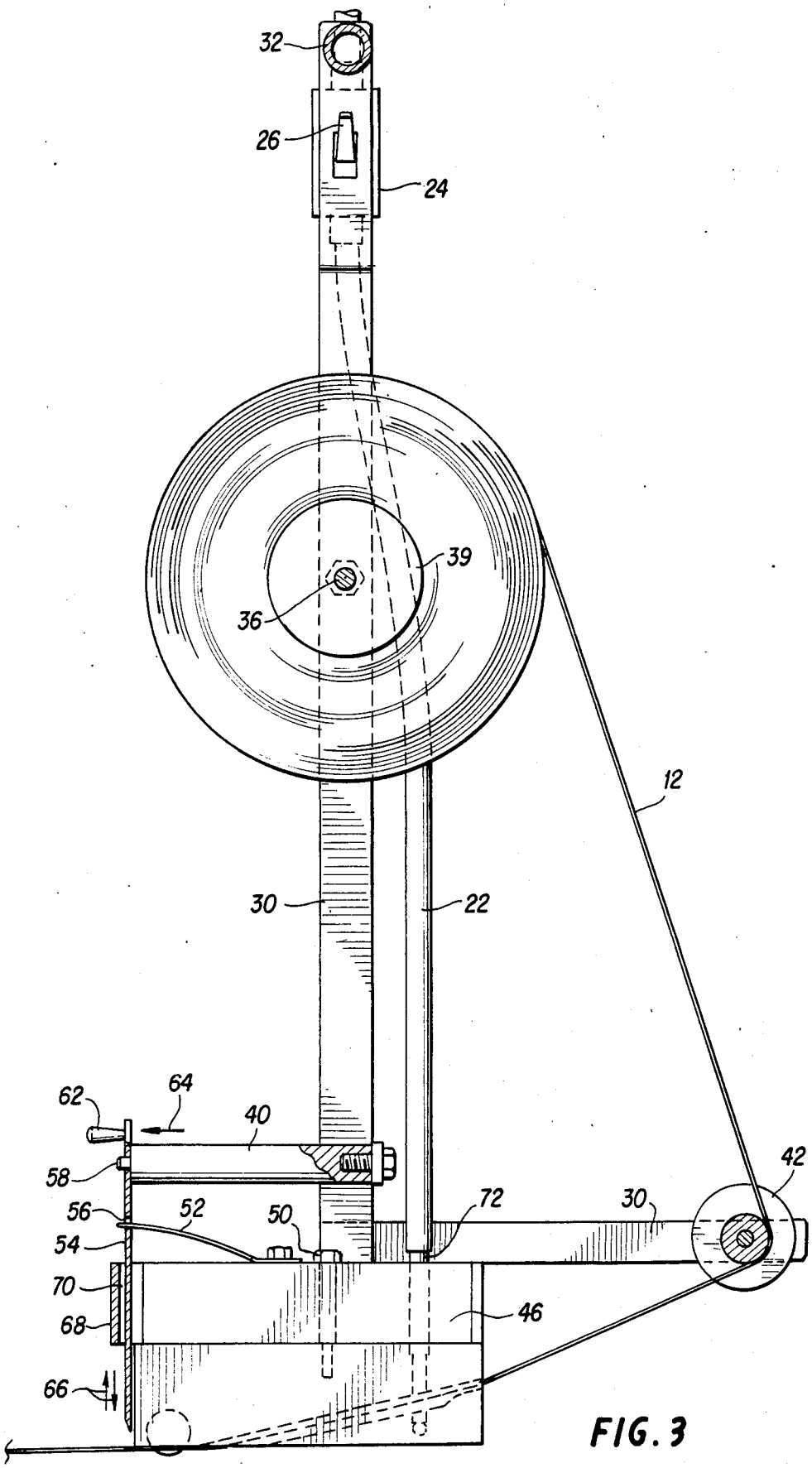
FIG. 3 is a side elevation view of the applicator, partially in section, showing the feed path of the tape through the applicator nozzle.
Figure 4:
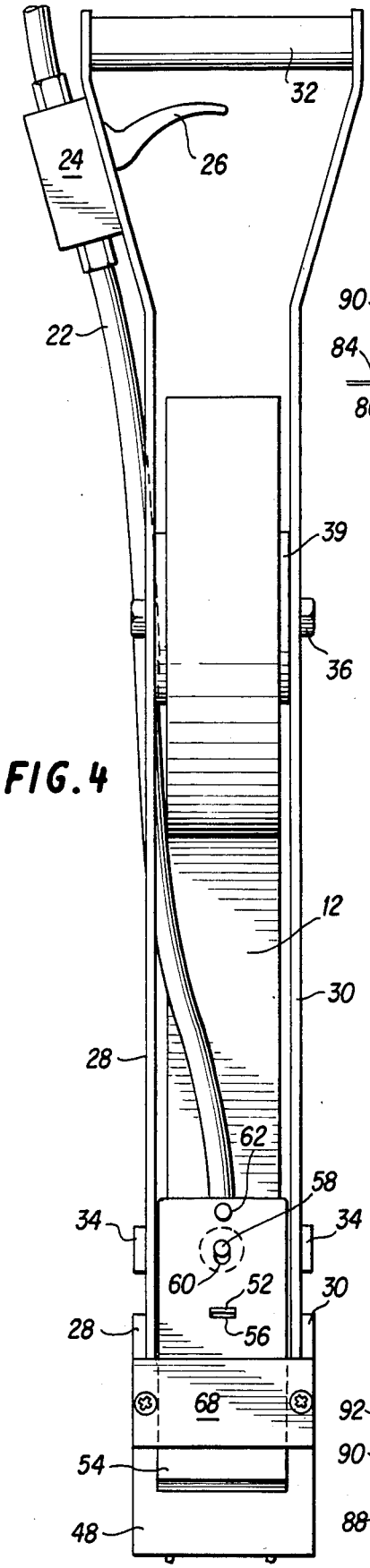
FIG. 4 is an end elevation view of the applicator showing the tape cutting blade assembly.
Figure 5:
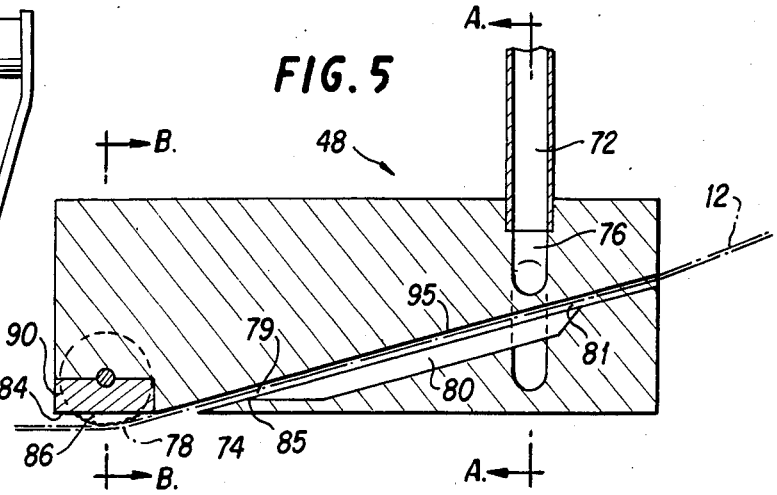
FIG. 5 is a longitudinal sectional view through the nozzle casing adapted for flat taping applications.

As shown in greater detail in FIGS. 2, 3 and 4, the applicator head includes a rectangular housing 46 and a nozzle casing 48. Casing 48 is a substantially rectangular block for applying tape and compound over flat surfaces such as crack 14 shown in FIG. 1. The housing 46 may be secured to the frame by welding or with mechanical fasteners and the casing may be detachably fixed to the housing by threaded fasteners 50.

One end of a leaf spring 52 is fixed to the upper surface of housing 46 while the other end is resiliently connected to cutter blade 54 via slot 56 formed within the blade. Anchor pin 58 projects from the end of grip bar 40 (FIG. 3) to serve as a seat for the cutter blade when the blade is cocked in a biased state. An anchoring recess or hole 60 is formed within blade 54 to releasably receive the anchor pin.

Blade cocking handle 62 is rigidly fixed to the cutter blade for cocking the blade against the bias of the leaf spring. Once cocked and locked on the anchor pin, the blade may be released to cut the tape by simply sliding the blade off the anchor pin with a light thumb pressure applied in the direction of arrow 64. The leaf spring then drives the blade to the wallboard to cut the tape, then rebounds returning the blade to a neutral position slightly above the wallboard. Thus, the cutter blade undergoes a reciprocatory cutting stroke under the action of the leaf spring as shown by directional arrows 66 and may be quickly and easily reset for a subsequent cut.

The motion of the cutting blade is guided by blade guide block 68 which is securely fastened to the end face of the housing 46. A guideway or slot 70 is formed within the guide block to receive and guide the blade during cutting and cocking operations.

Figure 6:
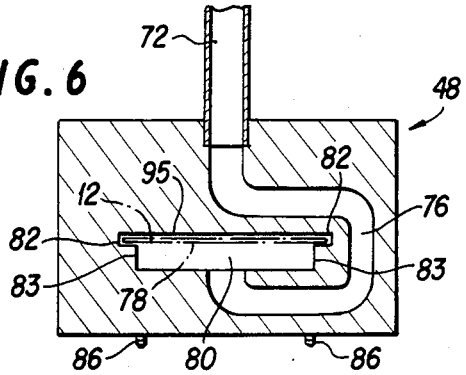
FIG. 6 is a transverse sectional view through the nozzle casing taken along line A—A of FIG. 5.
Figure 7:
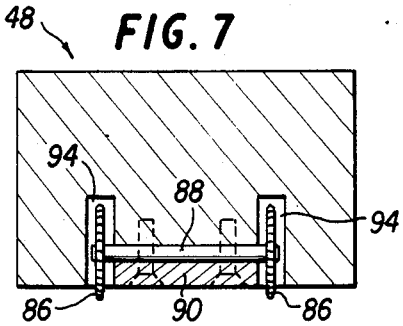
FIG. 7 is a transverse sectional view through the nozzle casing taken along line B—B of FIG. 5.
Figure 8:
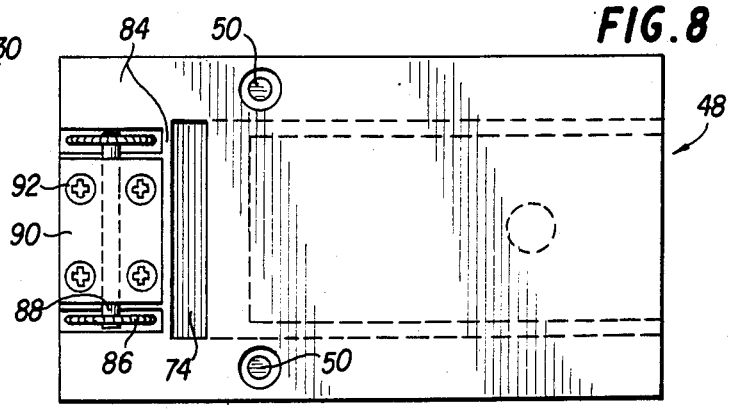
FIG. 8 is a bottom plan view of the nozzle casing of FIG. 5.

Details of the nozzle casing 48 are shown in FIGS. 5 through 9 wherein rigid feed tube 72 is snugly fitted within the casing for channelling wallboard compound from hose 22 through the nozzle casing to the nozzle port 74. A feed channel 76 is formed within the casing and, as best seen in FIG. 6, defines a substantially 270 degree arc in order to reverse the direction of flow of compound so that the underside 78 of tape 12 is coated with compound, leaving the upper side of the tape dry.

A critical aspect of the invention is the provision of a storage chamber 80 within the nozzle casing 48. Chamber 80 serves as a surge tank or fluid capacitor for the pressurized wallboard compound and ensures that an even, continuous, bubble-free and lump-free coating of compound is applied to the underside of the tape, regardless of the rate at which the tape is applied to the wallboard. In practice, an operator will often apply wallboard tape in an intermittent manner, sometimes imparting a jerking or discontinuous stop-and-go motion to the tape. With conventional applicators, such tape dispensing motion would often result in an uneven coating of compound applied to the tape. Discontinuities in the applied layer of compound would result, such as thin compound sections or dry tape sections with no compound, as well as thick, bumpy or lumpy regions. Also associated with such conventional devices is the formation of bubbles or voids within the compound caused by an uneven or jerky motion of the applicator.

By providing a redundancy of contact area between the tape and the compound and by surrounding such contact area with an adequately sized chamber, such as chamber 80, an even and continuous application of compound will result, notwithstanding an uneven tape application rate, or a jerking stop-and-go application of tape. A satisfactory tape contact area has been found through experimentation to range from approximately one square inch to 6 square inches, with a preferred range of 1.5 square inches to 3 square inches. The volume of chamber 80 can vary from one-quarter cubic inch to 3 cubic inches, with a preferred range of approximately one-half cubic inch to one and one-half cubic inches. It has also been found that as the pressure within container 20 is increased, the volume of chamber 80 may be decreased, since the flow rate of compound is increased in this manner, and the chamber is more rapidly replenished with compound, thereby necessitating a smaller surge tank or fluid capacitor to accommodate uneven application rates. The reservoir of compound stored in chamber 80 is prevented from leaking by the formation of nip regions 79 and 81 which restrict the flow of compound. Region 79 further serves to smoothly wipe the compound against the underside of the tape with wiping ridge 85.

As further seen in FIG. 6, chamber 80 is dimensioned with a width somewhat less than the width of the tape. Since the compound tends to spread out toward the edges of the tape when applied to the wallboard under the compressive force of the casing 48, there is no need to apply compound over the entire width of the tape. This feature prevents the waste of compound and, more importantly, obviates any clean-up or wiping procedures after the tape has been applied to the wallboard.

Conventional applicators usually apply compound over the entire underside of the tape. This often leaves bulges or ridges of compound along the edges of the tape as the compound is squeezed sidewardly from beneath the tape. These ridges must be wiped away. This wiping is burdensome, time consuming and uneconomical. The present invention avoids these drawbacks by the relative dimensioning of the tape and chamber. That is, guide slots 82 formed above and outwardly of the sidewalls 83 of chamber 80 are slightly thicker than the thickness of the tape so that little, if any, compound enters these slots. When applied to wallboard, these dry edge areas are covered with compound as the compound is forced under these edges by the manual pressure applied by the operator of the applicator. Once the tape exists nozzle port 74, it is pressed against the wallboard by the lower face 84 of the casing to effect the spreading of compound.

A positive no-slip tape feed is ensured by tractor drive wheels 86 which perforate the tape and puncture and grasp the surface of the wallboard so that the tape is pulled through the casing 48 under the pulling action of the wheel teeth. Wheels 86 may be mounted on a dead axle 88 which is clamped against the casing by block 90 with fasteners 92. Recesses 94 are cut into the casing to provide clearance for the tractor wheels.

An added benefit of guiding the tape through guide slots 82 such that the dry upper face of the tape slides against the ceiling surface 95 of chamber 80 is the creation of a fail-safe mechanism which positively prevents the operation of the applicator with an overpressurized compound container or an overpressurized feed line. That is, should the compound be incorrectly pressurized to a point where excessive compound could possibly exit from port 74, the tape will be forced against the ceiling 95 of chamber 80 with the correspondingly increased contact pressure of the compound, thereby generating a higher frictional force between the tape and compound and between the tape and ceiling. This increased resistance must be overcome in order to dispense the tape. An operator will immediately recognize this overpressurized condition since the tape will not exit port 74 until the pressure is reduced to a suitable level. This can be easily achieved with a simple adjustment of valve 26 or by bleeding off some air pressure from container 20. In this manner, a proper compound dispensing rate can be ensured with suitable dimensioning of chamber 80 so that the release of excessive compound is prevented, thereby further avoiding any need for a clean-up or wiping procedure.

Figure 9:
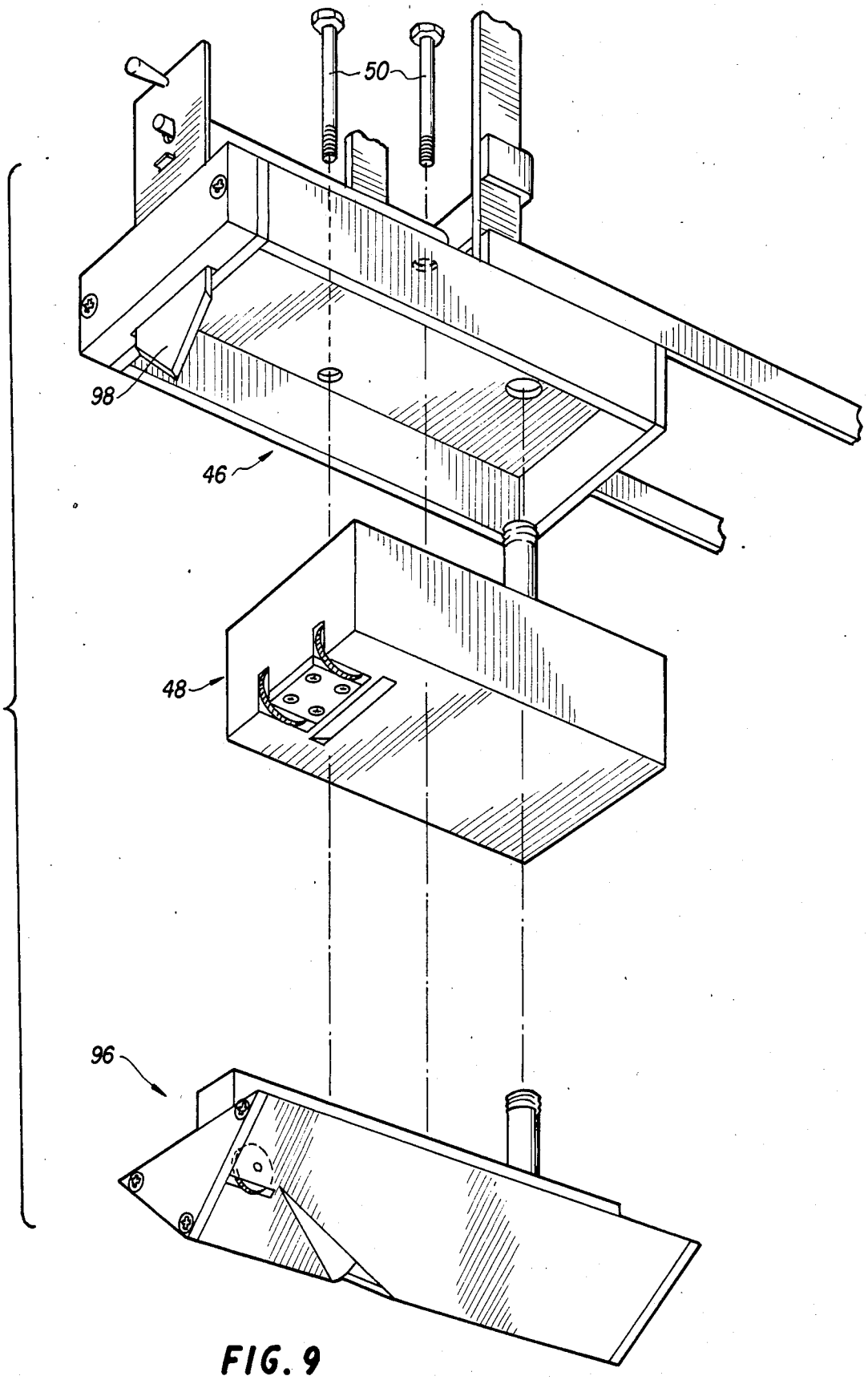
FIG. 9 is a perspective, partially exploded view of the applicator head showing the modular interchangeability between nozzle casings for flat and corner applications.

As shown in FIG. 9, the applicator head is adapted for modular interchange between nozzle casing 48 for flat surface applications and nozzle casing 96 for corner applications. A beveled blade 98 replaces flat blade 54 when nozzle casing 96 is used. Interchange of nozzle casings is achieved by disconnection of the hose 22 from feed tube 72, removal of fasteners 50 and exchange of the nozzle casings. The feed tube is then reconnected and the fasteners secured.

Details of the nozzle casing 96 are shown in FIGS. 10–22. As best seen in FIGS. 10–14 and 20, casing 96 includes two major components, the tape guide block 100 and the guide block trough 102. As shown in FIGS. 14 and 20–22, the guide block 100 is slidably fitted within the trough 102 with a slight friction fit to facilitate removal and cleaning. The guide block 100 initially creases the tape at its entry point into the block and later unfolds or spreads the tape at its exit point from the block while providing a compound reservoir or chamber between these points for applying compound exclusively over the bottom surface of the tape.

A somewhat modified feed tube 104 passes through the guide block body 106, terminating in a bifurcated, flattened, duck-bill nozzle 108. Body 106 may be homogeneously molded as one piece around the feed tube and formed of a wear-resistant material such as nylon. Communicating with a nozzle bifurcating slot 110 is a tape creasing channel 112 which, after passing through the nozzle, opens up into a compound storage reservoir or storage chamber 114 within which the compound is applied to the tape. Reservoir 114 serves the same purpose as the surge tank or chamber 80 discussed above, in that reservoir 114 provides a fluid capacitance within the compound feed path to ensure an even, uninterrupted application of compound to the tape, even during intermittent and/or uneven tape feeding and application rates. Reservoir 114 is demensioned with approximately the same volume as chamber 80.

Figure 19:
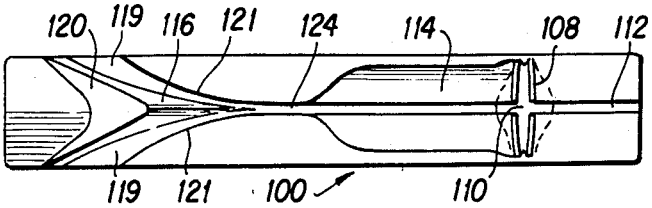
FIG. 19 is a bottom plan view of the tape guide block.
Figure 22:
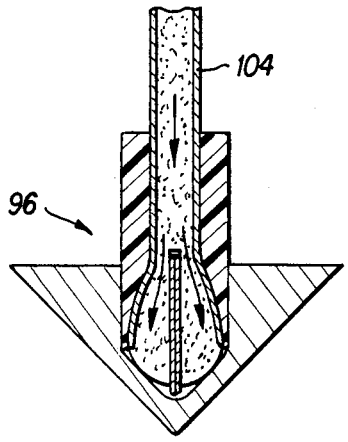
FIG. 22 is a transverse sectional view of the nozzle casing taken along line J—J of FIG. 20 showing the tape in a creased condition within the creasing channel.

The tape is maintained in a folded or creased condition during its passage through the reservoir 114 to prevent the upper tape surface from contacting the compound. This creased condition is best seen in FIG. 22. A tape spreading wedge 116 is formed on the guide block to guide the tape through the V-shaped slot 118 formed in the trough 102. As seen in FIG. 19, creasing channel 112 splits into two diverging channels 119 which are positioned adjacent slot 118 (FIGS. 10 and 12–14) when guide block 100 is mounted within trough 102. Channels 119 facilitate the initial loading or "threading" of tape through casing 96 with guide walls 121 which also support the tape against the pressure of the compound. The length of each of channels 119 is substantially co-extensive with the length of each corresponding branch of V-slot 118.

Figure 14:
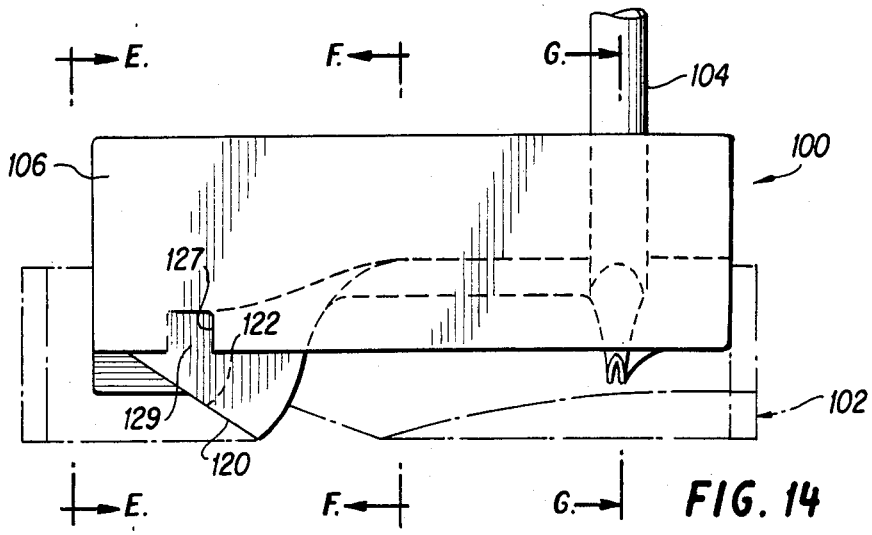
FIG. 14 is a side elevation view, partially in phantom, of the nozzle casing for corners.
Figure 15:
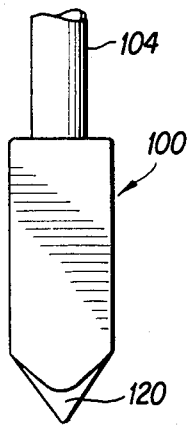
FIG. 15 is a transverse sectional view of the tape guide block taken along line E—E of FIG. 14.
Figure 16:
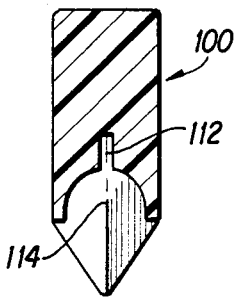
FIG. 16 is a transverse sectional view of the tape guide block taken along line F—F of FIG. 14.
Figure 17:
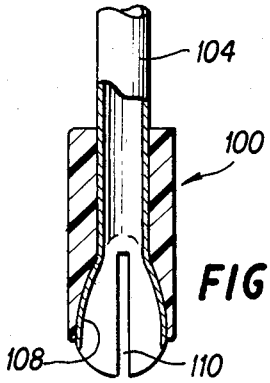
FIG. 17 is a transverse sectional view of the tape guide block and feed tube taken along line G—G of FIG. 14.
Figure 18:
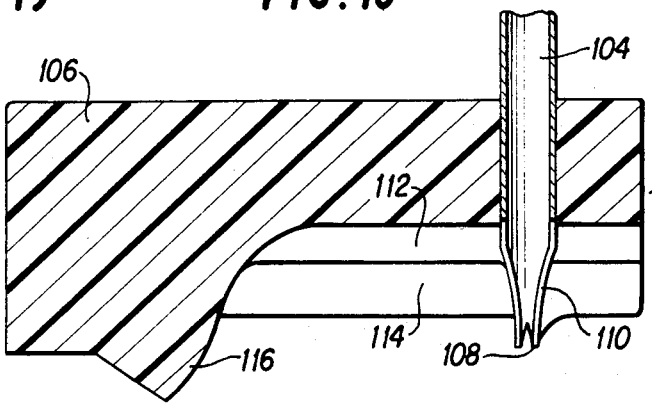
FIG. 18 is a longitudinal sectional view of the tape guide block and feed tube taken along line H—H of FIG. 10.

The lower surface 120 of the wedge forms a seal against the upper surface 122 of the trough as best seen in FIG. 14. Excess compound is prevented from exiting V-slot 118 by the necked-down region 124 which serves to resist the flow of compound through the slot. Moreover, as the tape is spread by wedge 116, it is lightly forced against lower wiping edge surfaces 26 of the trough which further restricts the excess passage of compound from V-slot 118. These wiping surfaces also ensure a smooth, even coating of compound applied to the lower surface of the tape. As with nozzle casing 48, the tape dispensed with nozzle casing 96 is substantially free of compound along its edge regions to accommodate the sideward or lateral spreading of tape as the forward portion 125 of the nozzle (FIGS. 12 and 13) flattens and wipes the tape into wallboard corner joints.

Figure 20:
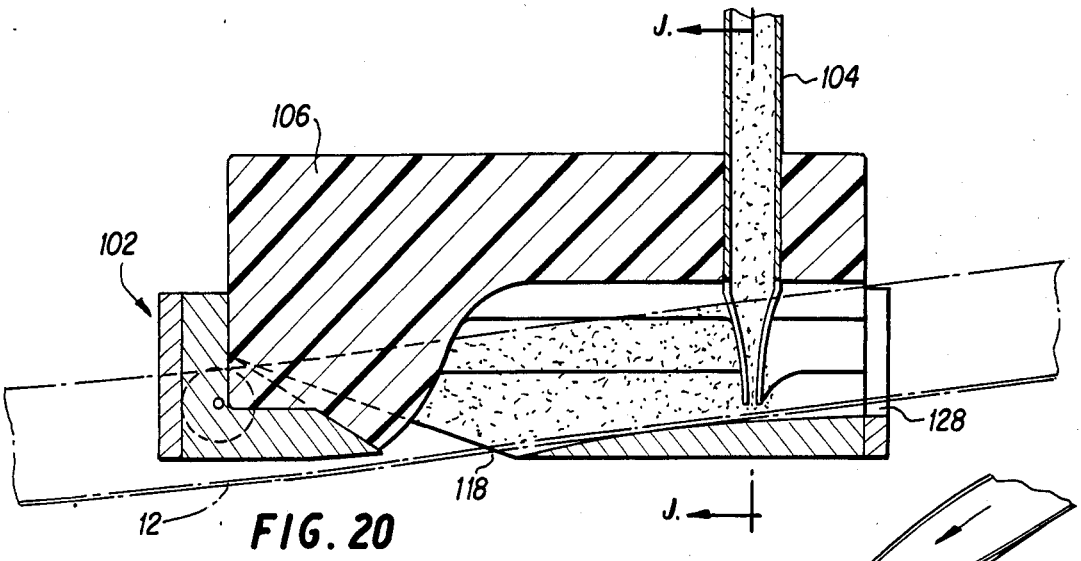
FIG. 20 is a central sectional side elevation view of the nozzle casing for corners, showing the internal path of the tape through the casing.

A feed slot 128 is formed in the trough and end wall 130 for initially guiding the tape into the tape creasing channel 112. Tractor wheels 86 are provided adjacent the V-slot for positively gripping and metering the delivery of tape and compound through the applicator. The trough floor 132 gradually slopes downward1y, as seen in FIGS. 12, 14 and 20 to further guide the tape through the V-slot.

Figure 21:
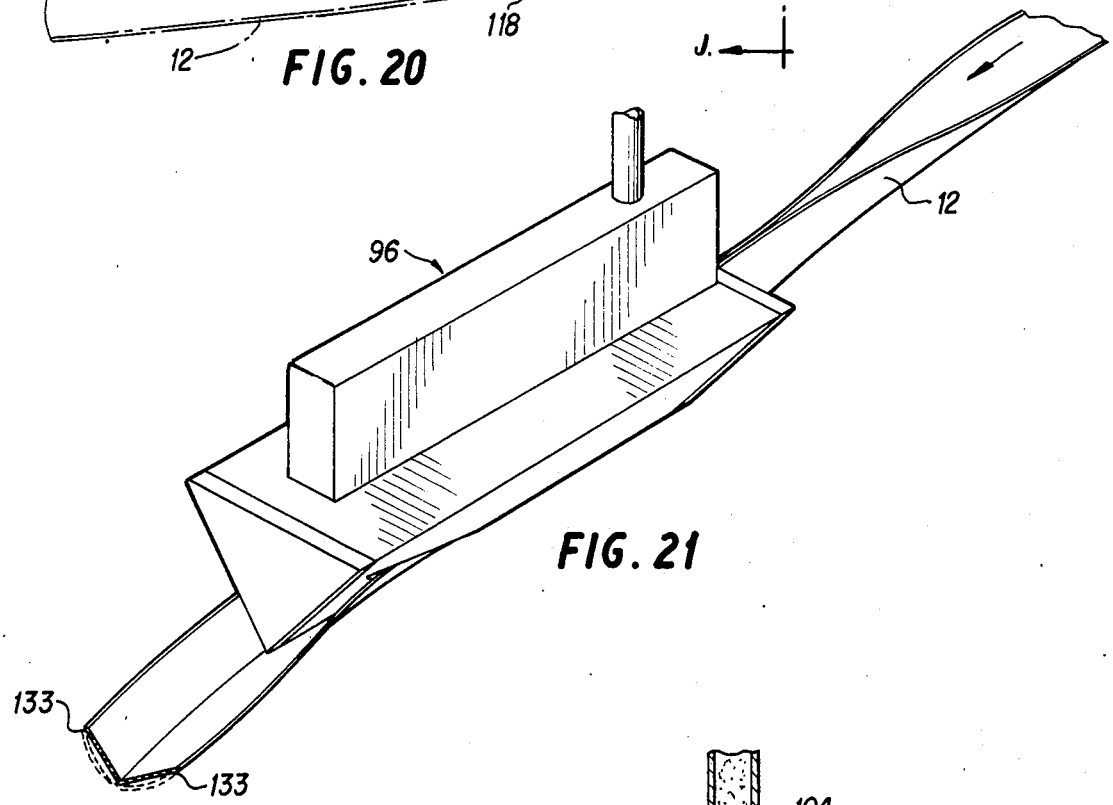
FIG. 21 is a perspective view of the nozzle casing for corner applications showing the manner in which the tape is dispensed through the nozzle casing.

The compound free edge portions may each extend over a lateral distance from about 1/16 inch to about ½ inch. Wiping of compound from the lower edge portions of the tape is accomplished with wiping slot 127 (FIGS. 10 and 14) which removes substantially all the compound from the tape edges with a pinching action. Because of the close clearance fit between wedge wiping surface 129 and the upper wiping surfaces 131 of the V-slot 118 (FIGS. 10, 12–14), the compound is further prevented from being dispensed along the lower edge portions 133 of the tape. This distribution of compound is best seen in FIG. 21.

An applicator constructed in accordance with the description set forth above is easy to manipulate due to its relatively light weight. Since only a small amount of compound is stored within the applicator head, the weight of the compound is negligible. Moreover, the moving parts of the applicator have been minimized to increase its reliability and minimize repairs. Since the under surface of the nozzle casing laterally spreads the compound under the dry edge sections of the tape in a predetermined manner, no excess compound is extruded or spread beyond the sides of the tape. This obviates any clean-up or subsequent wiping procedure which saves time, saves compound and results in a superior joint.

Obviously, numerous modifications and variations of the present invention are possible in light of the above teachings. It is therefore to be understood that within the scope of the appended claims, the invention may be practiced otherwise than as specifically described herein.

What is claimed is:

1. A nozzle for dispensing wallboard tape and wallboard compound, comprising:

A casing having an internal passage formed therein for guiding said tape therethrough;

tape creasing means provided in said casing for longitudinally folding said tape within said internal passage;

compound feeding means communicating with said internal passage for applying said compound to said tape; and wedge means provided within said casing and disposed adjacent said passage for unfolding said tape upon exit from said casing.

2. The nozzle of claim 1 wherein said compound is applied to said tape within said casing.

3. The nozzle of claim 1 wherein said internal passage defines a necked-down region for preventing excess compound from exiting said casing.

4. The nozzle of claim 1 wherein said internal passage exits said casing through a v-shaped slot.

5. The nozzle of claim 1 wherein said internal passage splits into a pair of diverging channels disposed adjacent said tape unfolding means.

6. The nozzle of claim 1 wherein said casing further comprises wiping means disposed adjacent said tape unfolding means for wiping excess compound from said tape.

7. The nozzle of claim 6 wherein said wiping means comprises means for removing said compound from edge portions of said tape.

8. The nozzle of claim 1 wherein said compound feeding means comprises a compound feeding tube for introducing said compound into said internal passage.

9. The nozzle of claim 8 wherein said feed tube is formed with a slot through which said tape passes.

10. The nozzle of claim 1 wherein said tape creasing means folds said tape within said passage such that said compound is applied exclusively to one side of said tape.

* * * * *